United States Patent [19]

Shang et al.

[11] Patent Number: 4,466,360

[45] Date of Patent: Aug. 21, 1984

[54] LOOP-BED COMBUSTION APPARATUS

[75] Inventors: Jer-Yu Shang, Fairfax, Va.; Joseph S. Mei, Morgantown, W. Va.; Frank D. Slagle, Kingwood, W. Va.; John E. Notestein, Morgantown, W. Va.

[73] Assignee: The United States of America as represented by the United States Department of Energy, Washington, D.C.

[21] Appl. No.: 449,793

[22] Filed: Dec. 14, 1982

[51] Int. Cl.[3] ..... F23D 1/02

[52] U.S. Cl. ..... 110/264; 110/347

[58] Field of Search ..... 110/261, 263-265, 110/347

[56] References Cited

U.S. PATENT DOCUMENTS 2,900,930 8/1959 Cermak ..... 110/264

3,136,536 6/1964 Heinemann ..... 110/347

*Primary Examiner*—Carroll B. Dority, Jr.

*Attorney, Agent, or Firm*—Earl L. Larcher; Stephen D. Hamel; Michael F. Esposito

[57] ABSTRACT

The present invention is directed to a combustion apparatus in the configuration of a oblong annulus defining a closed loop. Particulate coal together with a sulfur sorbent such as sulfur or dolomite is introduced into the closed loop, ignited, and propelled at a high rate of speed around the loop. Flue gas is withdrawn from a location in the closed loop in close proximity to an area in the loop where centrifugal force imposed upon the larger particulate material maintains these particulates at a location spaced from the flue gas outlet. Only flue gas and smaller particulates resulting from the combustion and innerparticle grinding are discharged from the combustor. This structural arrangement provides increased combustion efficiency due to the essentially complete combustion of the coal particulates as well as increased sulfur absorption due to the innerparticle grinding of the sorbent which provides greater particle surface area.

8 Claims, 1 Drawing Figure

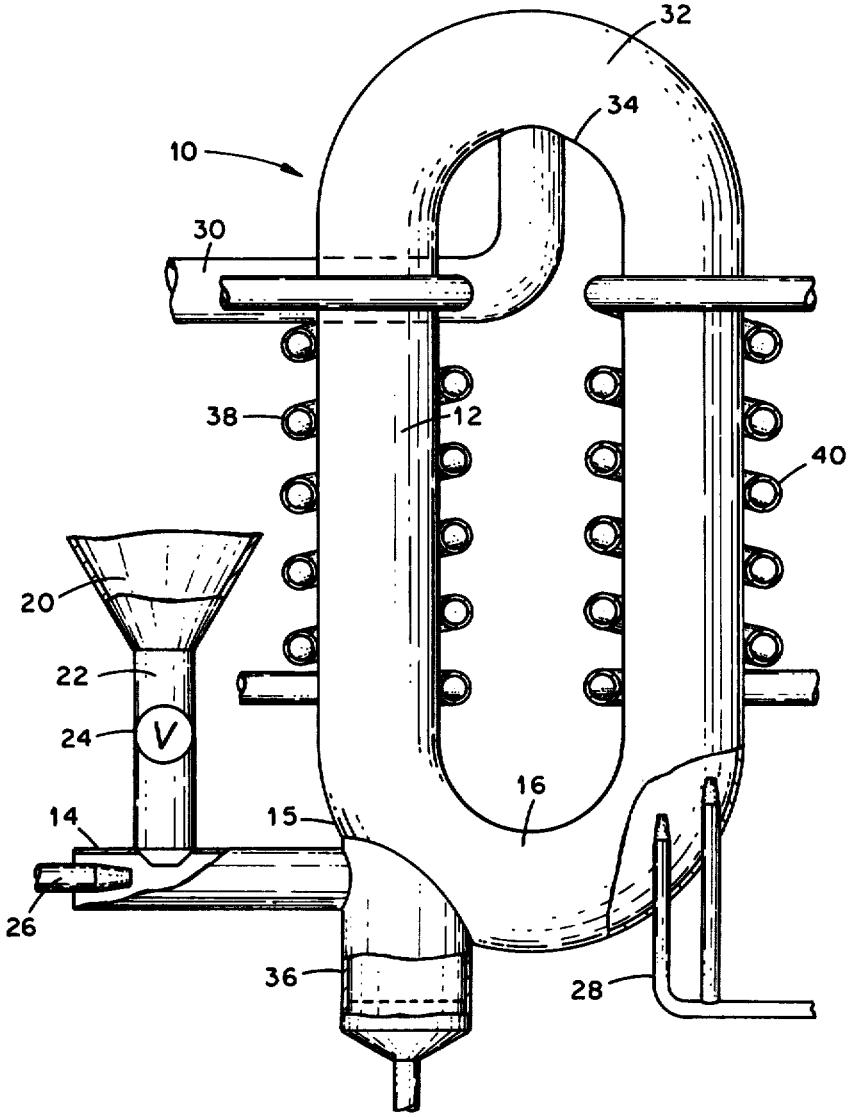
32
34
10
30
38
12
40
20
22
24
V
16
14
15
26
36
28

LOOP-BED COMBUSTION APPARATUS

BACKGROUND OF THE INVENTION

The present invention is directed generally to combustion apparatus or boilers utilized for the extraction of energy values from hydrocarbon fuels such as coal or from hydrocarbon fuels contained in oil shales and similar-type containments, and more particularly, to a combustor in the configuration of a continuous loop for providing constant recycling of unburned fuel particulates for effecting the efficient extraction of energy values from the fuel.

The extraction of heat energy from hydrocarbon fuels such as coal, has long been a standard. However, with the ever increasing cost of such fuels and the impact on the environment caused by the burning of such fuels, considerable changes in the various combustion systems were required to meet demands for an efficient energy extraction system which will satisfy environmental standards. The conventional boiler systems such as pressurized combustors, are somewhat inefficient in that considerable quantities of combustible organic material is discharged with the ash and flue gas. Further, the sulfur compounds and nitrogen oxides escaping with the flue gas have had a considerable impact upon the environment.

Efforts to provide an efficient combustion system which will satisfy environmental standards has been substantially satisfied by the use of the fluidized bed combustion system. Such a system provides for efficient fuel combustion, heat transfer and desulfurization in a single reactor which effectively eliminates desulfurization and nitrogen oxide removal units required of previous combustion systems. In a fluidized bed reactor, the combustion air passes through a fluidized bed of coal, ash particles, and sulfur sorbent material such as limestone or dolomite, at various velocities to provide the fluidized turbulent motion of these particles within the fluidized bed. The turbulent motion results in efficient combustion of the combustible organic material and provides for the continuous stirring of the sorbents to effectively reduce the sulfur dioxide concentration in the flue gas.

While the fluidized bed combustor has provided a considerable advancement in the combustion art, several shortcomings are still present with the fluidized bed combustion system which detract from the overall efficiency thereof. For example, in a fluidized bed combustor, a high freeboard area is required for effecting essentially complete combustion of combustible organic material in the freeboard. However, because of this height requirement, a substantial temperature variation exists in the freeboard such that some nitrogen oxides are discharged from the system. Further, even with a high freeboard area, there is still a relatively high percentage of the combustible organic material which escapes with the flue gas. The elutriation of unburned carbon fines in the flue gas has been a major contribution to poor combustion efficiency. Elaborate afterburner provisions such as a carbon burn-up cell and flyash reinjection have been used to minimize this problem. However, the complexity of these afterburner provisions has increased the difficulties of combustion operation.

SUMMARY OF THE INVENTION

Accordingly, it is the primary aim or objective of the present invention to provide an improved combustion system. This combustion system comprises a combustor in the form of a continuous loop so that the combustible material introduced into the system is continuously circulated in a dilute phase until the combustible material is effectively consumed. More specifically, the loop-bed combustion apparatus of the present invention comprises a vertically oriented tubular housing in the configuration of an oblong annulus. Conduit means are coupled at the outer peripheral surface of the housing at a location adjacent to the lowermost bight defined by the oblong annulus with the longitudinal axis of these conduit means being tangentially oriented with respect to the longitudinal axis of the tubular housing at the point of coupling. Means are provided for introducing particulate fuel into these conduit means and also pneumatic means are associated with the conduit means for unidirectionally propelling the particulate fuel from the conduit means into the tubular housing. Downstream from this introduction point are disposed further pneumatic means for driving the particulate fuel through the length of the annulus and for providing combustion support medium for effecting the combustion of the particulate fuel when ignited. A discharge port means is disposed through the innermost peripheral surface or wall of the annular housing at a location in or slightly downstream from the uppermost bight defined by the oblong annulus with this discharge port means adapted to receive gaseous combustion products and particulates of a size less than that maintainable in close proximity to the radially outermost portion of the uppermost bight by the centrifugal forces imposed upon the particulate material as it is propelled through the housing.

Limestone or dolomite particulates may also be introduced along with the fuel for absorbing the sulfur compounds generated during the combustion of the fuel. The high pressure jets or pneumatic means utilized to propel the particulate material (fuel and sulfur sorbent) about the loop are aided by a high degree of turbulence to effectively force the solid particulate material to be impelled against each other in a grinding manner to form smaller particulates for improved combustion and sulfur sorption. As pointed out above, the larger particles are kept inside the loop until the size thereof is reduced by combustion and grinding to a sufficient size small enough to be discharged with the flue gas. The grinding of the sulfur sorbents, limestone and dolomite will generate more surface area for sulfur dioxide capture. The conventional fluidized-bed combustion generates sulfated limestone ($CaSO_4$) only at the outermost layer. The thickness of the sulfate layer is about 30 to 50 microns. The interparticle erosion will polish off the sulfate layer and provide new surface area for more sulfur retention and high calcium utilization.

Other and further objects of the invention will be obvious upon an understanding of the illustrative embodiment and method about to be described or will be indicated in the appended claims, and various advantages not referred to herein will occur to one skilled in the art upon employment of the invention in practice.

DESCRIPTION OF THE DRAWING

The FIGURE is a somewhat schematic view of the loop-bed combustor of the present invention.

A preferred embodiment of the invention has been chosen for the purpose of illustration and description. The preferred embodiment illustrated is not intended to be exhaustive or to limit the invention to the precise form disclosed. It is chosen and described in order to best explain the principles of the invention and their application in practical use to thereby enable others skilled in the art to best utilize the invention in various embodiments and modifications as are best adapted to the particular use contemplated.

DETAILED DESCRIPTION OF THE INVENTION

In the accompanying drawing, the loop-bed combustor which may be used in either an atmospheric or pressurized operation is generally shown at 10 and comprises a tubular housing 12 in the configuration of a vertically oriented oblong or prolated annulus with the sides of the housing being generally parallel to one another as shown. The diameter of the tubular housing is shown as being essentially uniform about the entire length thereof but can be varied in areas such as between the looped ends so as to enhance combustion and particle grinding which would increase the overall efficiency of the combustion operation. A conduit 14 is coupled to the outer wall surface 15 of the tubular housing at a location adjacent the lower bight 16 of the annulus or loop. This conduit 14 is disposed so that the longitudinal axis thereof is on a tangent with the longitudinal axis of the tubular housing 12 at the point of contact with the housing for facilitating the introduction of particulate material into the housing 12. The conduit 14 is in turn coupled by conduit 22 to a hopper 20 containing a supply of particulate coal in size range of about 0 to 8 mesh. Sulfur sorbents such as dolomite or limestone in particulate form may be admixed with the coal in the hopper 20 for introduction into the combustion system. A valve 24 is conveniently placed within the conduit 22 for regulating the flow of particulate material from the hopper 20 into the combustor 10.

In order to propel or move the particulate material into the tubular housing 12 of the combustor 10 as well as to provide some impetus for propelling the particulate material about the interior of the housing in a recycling manner, a pneumatic jet or aspirator is generally shown at 26. The pneumatic jet provides a flow of combustion supporting medium, e.g., air, which contacts the particulates emmanating from the feed hopper conduit 22 and propels them into the combustion zone at a tangent so as to mingle with the circulating particulates in such a manner as to cause minimal disturbance or interuption to either flow.

A plurality of nozzles or injectors 28 (two shown) are disposed in the combustor housing 12 and project along a plane parallel with the longitudinal axis of the tubular housing at a location downstream of the injection point of the particulate material. These injectors 28 introduce additional combustion supporting medium which is used to propel the particulate material through the combustor housing 12 at a high rate of speed. This propulsion of the particulate material during the combustion process promotes interparticle contact that effectively grinds the particulate material to a smaller sizes.

The flue gas resulting from the combustion of the coal or other combustible material utilized in the annular combustor, is discharged through a conduit 30 which is disposed at the uppermost bight 32 of the tubular housing and penetrates the inner wall 34 of the housing 12 as shown. The particular location of the coupling between this discharge conduit 30 and the tubular housing is at a location within or slightly downstream from the bight 32 where the centrifugal forces acting upon the particulate material within the tubular housing 12 as material is propelled about the interior thereof are sufficient to maintain the larger particulate material near the outer wall of the housing and away from the discharge conduit opening. Thus, flue gas emanating from the housing will contain only the particulate material which has been burned or ground to a particle size less than that sufficiently influenced by the centrifugal force so as to keep away from the discharge opening. This structural arrangement is particularly advantageous in that the particles discharged will have undergone essentially complete combustion or sorption of the sulfur. Normally, this particle size range is about 5 micron down to submicron size with a fluid stream being propelled through the housing at a speed of about 20 to 80 feet per minute.

In order to initiate the combustion of the coal or other combustible particulate material within the combustor 10, a fluidized bed combustion arrangement generally shown at 36 may be utilized. This fluidized bed is shown coupled to the tubular housing 12 at or adjacent to the point of contact between the conduit 14 and the housing wall 15. Coal from the hopper 20 is ignited in the fluidized bed to provide a sufficient temperature to effect the combustion of the coal particulates subsequently entering the housing through the conduit 14. Once combustion is initiated in the recirculating particles, the operation of the fluidized bed ignitor may be terminated since the combustion of the particulates will be self-sustaining.

The heat exchangers as shown at 38 and 40 may be disposed in or about the tubular housing 12 for extracting heat energy values from the combustion process occurring therein. Alternatively, the heat values may be extracted from the flue gas by using a heat exchange arrangement disposed outside the combustor and contactable by the flue gas.

The sulfur compounds generated in the combustor are effectively absorbed by the addition of the dolomite, limestone or other sorbant material either to the coal feed or separately into the reactor. The continuous grinding action upon the sorbant in the combustor removes the outermost surface layers of the sorbent so as to provide fresh surfaces for enhancing sulfur capture and retention. It is expected that this continuous grinding motion will provide a significant increase in the sulfur capture over that provided in conventional fluidized beds in that the inner particle attrition provides a considerably greater surface area than that available in normal combustor operations.

In a typical operation, the particulate coal and sulfur sorbent is introduced through the hopper 20 into the conduit 14 and injected into the combustor 10 by the aspirator 26. During initial phases of this aspiration or immediately prior thereto, particulate material in the fluidized bed combustion initiator 36 is fired to ignite the coal emmanating from the hopper through conduit 14 into the combustor 10. As the ignited coal is discharged into the loop-bed combustor by the aspirator, the actuation of the pneumatic jets 28 will propel the ignited coal about the loop in a very rapid manner. As these fired coal particles are circulated, the combustion process becomes sustained so as to allow for the termination of the fluidized-bed combustion initiator. With the ongoing combustion and intermixing of the particulate materials within the combustor, the particles are ground into smaller fractions, while being maintained against the outer wall surfaces in the area of the bights 16 and 32 during the recirculating so as to inhibit the discharge of the larger particle sizes through the discharge conduit 30. As the combustion process continues, this inner particle grinding reduces the coal particles as well as that of the sorbent to a size which will not be sufficiently propelled against the outer surface of the tubular housing by such forces so as to permit such particulate material to be discharged with the flue gas. This continuous combustion and grinding operation allows for a trouble-free operation devoid of any slag or other contaminants within the combustion loop.

In addition to the use of the closed loop-bed combustor of the present invention for the extraction of heat values from the coal, the loop-bed combustor may be used a reactor for the gasification of coal. This variation may be easily achieved by maintaining a substantially reducing atmosphere within the loop rather than an oxidizing atmosphere as required for the combustor above described. Additionally, retorting of oil shales by the use of pressurized hydrogen to enhance oil shale recovery from hydrogen defficient oil shales may be readily achieved within a loop-bed combustor of the present invention.

What is claimed is:

1. A loop-bed reactor or combustor comprising:

a vertically oriented tubular housing in the configuration of an oblong annulus;

conduit means coupled to the outermost peripheral surface of the housing at a location adjacent to the lowermost bight defined by the oblong annulus with a longitudinal axis of said conduit means being tangentially oriented with respect to the longitudinal axis of the tubular housing at the point of coupling therewith;

means for introducing particulate fuel into said conduit means;

pneumatic means in registry with said conduit means for unidirectionally propelling the particulate fuel into the housing;

further pneumatic means in registry with the housing downstream of the coupling between the conduit means and the housing for further propelling the particulate material through the length of the annulus; and discharge port means disposed through the innermost peripheral surface of the housing at a location in or slightly downstream from the uppermost bight defined by the oblong annulus with said discharge port means adapted to receive gaseous combustion products and particulate material of a size less than that maintainable in close proximity to the radially outermost portion of the uppermost bight by the centrifugal force imposed upon the particulate material by the pneumatic means when propelled through the housing.

2. A loop-bed reactor or combustor as claimed in claim 1, wherein ignition means comprising a fluidized bed combustion system is coupled to said housing at a location adjacent to the coupling of said conduit means with said housing for initiating the burning of particulate fuel conveyed into the housing through said conduit means.

3. A loop-bed reactor or combustor as claimed in claim 1, wherein said means for introducing particulate fuel into said conduit means comprises a hopper coupled to said conduit means, and wherein valve means are disposed in the coupling between the hopper and the conduit means for controlling the flow of particulate material into said conduit means.

4. A loop-bed reactor or combustor as claimed in claim 1, wherein the first mentioned pneumatic means is an aspirator.

5. A loop-bed reactor or combustor as claimed in claims 1 or 4 wherein said further pneumatic means comprises a plurality of nozzles disposed to provide pneumatic fluid along a plane substantially parallel with the longitudinal axis of the tubular housing at a location intermediate said lowermost bight and said uppermost bight.

6. A loop-bed reactor or combustor as claimed in claim 3, wherein particulate sulfur sorbent material is containable in the hopper and introducible with the particulate fuel into said conduit means.

7. A method for recovering energy values from solid particulate material containing such values comprising the steps of introducing particulate material into an enclosed volume in the configuration of an oblong annulus, igniting a combustible component in the particulate material, contacting the particulate material within the volume with a fluid stream of an adequate velocity to propel the particulate material about the enclosed volume of the annulus with sufficient force to maintain particulate material of relatively large particle size at a selected radially outwardly spaced location in said volume, and withdrawing gases and particulate material of a size less than maintainable in said selected radially outwardly spaced location in said volume from the latter at a location radially inwardly spaced from said radially outwardly spaced location.

8. The method claimed in claim 6, wherein the particulate material is coal, the fluid stream is a combustion supporting medium, and wherein a sulfur sorbent material in particulate form is introduced into said volume with said coal.

* * * * *